US005568888A

United States Patent [19]

Seber

[11] Patent Number: 5,568,888

[45] Date of Patent: Oct. 29, 1996

[54] COMPOSITE MOLDED KNIFE SHEATH

[75] Inventor: Brett P. Seber, Escondido, Calif.

[73] Assignee: Buck Knives, Inc., El Cajon, Calif.

[21] Appl. No.: 374,433

[22] Filed: Jan. 18, 1995

[51] Int. Cl.[6] ..... F41B 13/04

[52] U.S. Cl. ..... 224/232; 30/151

[58] Field of Search ..... 224/232, 912; 30/151

[56] References Cited

U.S. PATENT DOCUMENTS

| | | | |
|---|---|---|---|
| 2,361,735 | 10/1944 | Beckwith et al. | 224/232 |
| 4,263,714 | 4/1981 | Todd, Sr. | 30/151 |
| 5,146,684 | 9/1992 | Hagler | 224/232 X |
| 5,419,472 | 5/1995 | Hellweg et al. | 224/912 |

FOREIGN PATENT DOCUMENTS

| | | | |
|---|---|---|---|
| 2083599 | 3/1992 | United Kingdom | 224/232 |

*Primary Examiner*—Renee S. Luebke
*Attorney, Agent, or Firm*—Gregory Garmong

[57] ABSTRACT

A knife sheath has a skeleton housing and an attachment that is continuous with the skeleton housing at its upper end. A liner is formed within at least part of the interior of the skeleton housing and a coating is formed over at least part of the exterior of the skeleton housing. Preferably, the liner covers the entire interior, and the coating covers the edges and lower end of the skeleton housing, except for an optional access opening in each case. The liner and the coating are desirably continuous through communication holes in the skeleton housing and made of the same material. The skeleton housing is preferably made of a rigid plastic, and the liner and coating are preferably made of an elastomer.

19 Claims, 3 Drawing Sheets

COMPOSITE MOLDED KNIFE SHEATH

BACKGROUND OF THE INVENTION

This invention relates to knife sheaths, and, more particularly, to a knife sheath made of a composite construction.

Knife sheaths are widely used to store and carry fixed-blade or folding knives. The sheath generally includes an elongated receptacle sized to receive the knife blade with the handle protruding from the sheath, in the case of the fixed-blade knife, or the entire folded knife, in the case of the folding knife. The sheath may optionally include an attachment structure fixed to the receptacle, such as a belt loop or the like, to permit the receptacle to be attached to the belt of the user or other location. The sheath may also optionally include a retaining strap, a cover, or some other structure that holds the knife in the sheath.

Sheaths have been made from a wide variety of materials such as leather, natural or artificial fabrics, metals, and plastics. The sheath is usually made of a single principal material, with possibly other materials joined to the interior or exterior of the sheath for strength, durability, or decoration. As one example, some leather sheaths have metal strips along their edges to define the shape of the sheath and to improve its durability. In another example, some fabric sheaths include a plastic liner that fits loosely within a portion of the interior of the sheath to guide the knife blade into the sheath and retain the blade in a generally centered position so that the blade does not cut and damage the fabric.

The available types of knife sheaths perform satisfactorily in a wide variety of situations. However, in other situations they can have drawbacks. Many knife sheaths are not ergonomically designed to conform to the body of the person wearing the sheath, which can make the person uncomfortable as the sheath rubs against the side of the body. Some sheaths do not position the handle of the knife to be readily available to the hand of the user when the knife is to be withdrawn from the sheath. Similarly, the knife-receiving opening of the sheath may not be easily accessible so that the knife can be easily and smoothly inserted back into the sheath for storage without damaging the sheath. Other sheaths are noisy as the knife rattles against the inner surface of the sheath, or as the sheath itself slaps against the wearer's leg during walking or contacts features such as rocks that the wearer brushes against.

There is therefore a need for an improved knife sheath that is functional and quiet. The present invention fulfills this need, and further provides related advantages.

SUMMARY OF THE INVENTION

The present invention provides a knife sheath and a method for its fabrication. The knife sheath retains the knife securely and snugly therein, yet allows easy, smooth insertion of the knife into, and withdrawal of the knife from, the sheath. The knife sheath is ergonomically designed so as to be comfortable to wear and use. The knife is cushioned within the sheath and prevented from rattling or otherwise contacting any portion of the interior of the sheath which could result in noise. The exterior of the sheath is protected as well. The sheath is also highly resistant to damage by heat, chemicals, acid, and the like. The sheath is preferably manufactured using injection molding techniques.

In accordance with the invention, a knife sheath comprises a knife receptacle including a skeleton made of a first material. The skeleton comprises an elongated skeleton housing having a front side, an oppositely disposed back side, two oppositely disposed narrow edges, a generally closed lower end, and an open upper end. There is a liner made of a second material, with the liner covering at least a portion of an interior of the skeleton housing, and a coating made of a third material, with the coating covering at least a portion of an exterior of the skeleton housing.

In one preferred form, the sheath includes an access opening extending between the edges at the generally closed lower end of the sheath. This access opening penetrates through the coating, skeleton housing, and liner from one edge to the interior of the sheath, and then through the liner, skeleton housing, and coating on the other edge. The access opening is desirably a straight path that performs both as a lanyard receiver by which a lanyard is slidably affixed to the sheath so that the lower end of the sheath can be secured to the leg of the wearer, and as a drain hole so that water that finds its way into the sheath can be drained away. The sheath also includes an attachment extending upwardly from the upper end of the back side of the skeleton housing, which may be integral with the skeleton housing or may comprise a web. The attachment has a belt loop or other fixture to allow the sheath to be fixed to the belt of the wearer.

The skeleton is made of the first material, preferably a hard plastic such as a kevlar-filled nylon. The liner is made of the second material and the coating is made of the third material. The liner and the coating are desirably made as a continuous layer extending both to the interior and to the exterior of the skeleton, and are therefore desirably, but not necessarily, made of the same material. The preferred material for the liner and the coating is an elastomeric, rubbery material.

In another embodiment of the invention, a knife sheath comprises a skeleton made of a first material. The skeleton comprises an elongated skeleton housing having a front side, an oppositely disposed back side, two oppositely disposed narrow edges, a generally closed lower end, and an open upper end. A liner which covers an entire interior of the skeleton housing is made of a second material A coating which covers at least a portion, and optionally all, of an exterior of the skeleton housing is made of the same second material. The sheath includes means for forming a continuous path between the liner and the coating, including at least one communication opening extending through the skeleton housing between the liner and the coating. There is means for anchoring the liner to the skeleton housing, and means for anchoring the coating to the skeleton housing. The sheath includes an attachment.

In this approach, the liner and the coating are a continuous piece made of a single material. To ensure that the liner and the coating are securely fastened to the skeleton housing, at least one, and preferably a plurality of, openings are provided through the thickness of the skeleton housing. The openings permit the second material to flow therethrough during the preferred technique for fabrication of the sheath, and, after the second material has solidified, aid in drawing the liner and the coating toward each other and tightly against the skeleton housing. Additionally, there are preferably three-dimensional features such as channels formed in the skeleton housing so that the second material of the liner and the coating mechanically interlocks to the skeleton housing. These two approaches ensure that the liner and the coating do not separate from and pull free of the skeleton housing during service.

The sheath of the invention is preferably made by first injection molding the skeleton housing from the first material, and thereafter injection molding the liner and the coating overlying the skeleton housing. Where the liner and the coating are made of the same material, they are conveniently injection molded in a single step.

The knife sheath of the invention thus provides a readily fabricated sheath that is comfortable to use, functional, quiet in service, and inexpensive to manufacture. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENTS

Figure 1:
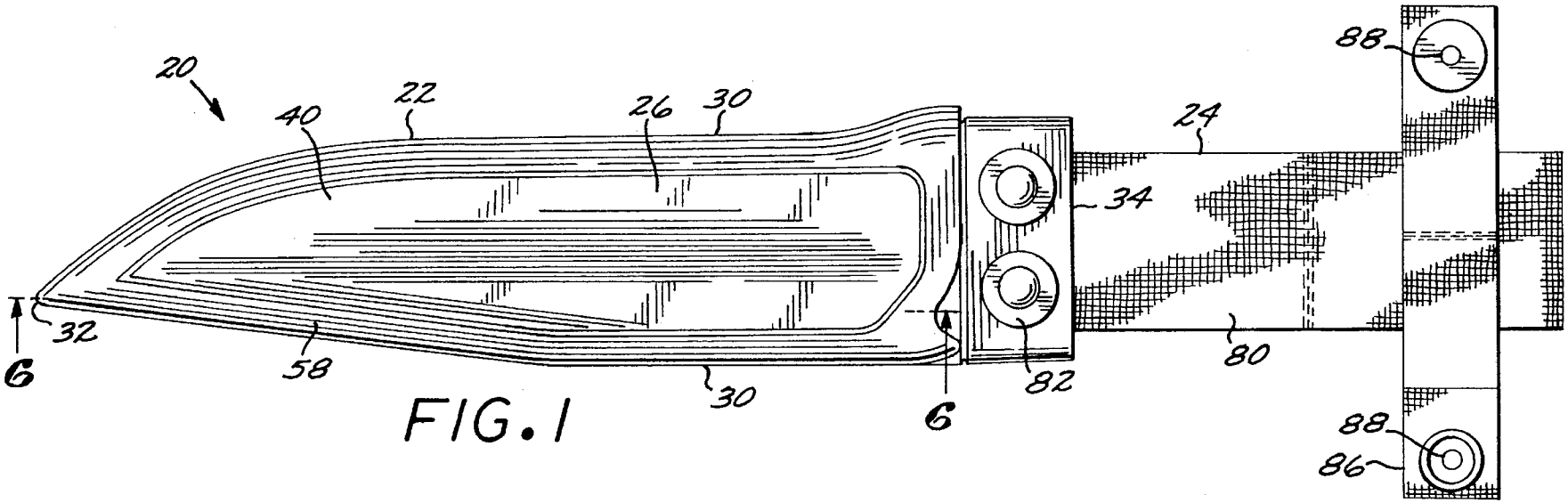
FIG. 1 is a front elevational view of a knife sheath made according to the present invention.
Figure 2:
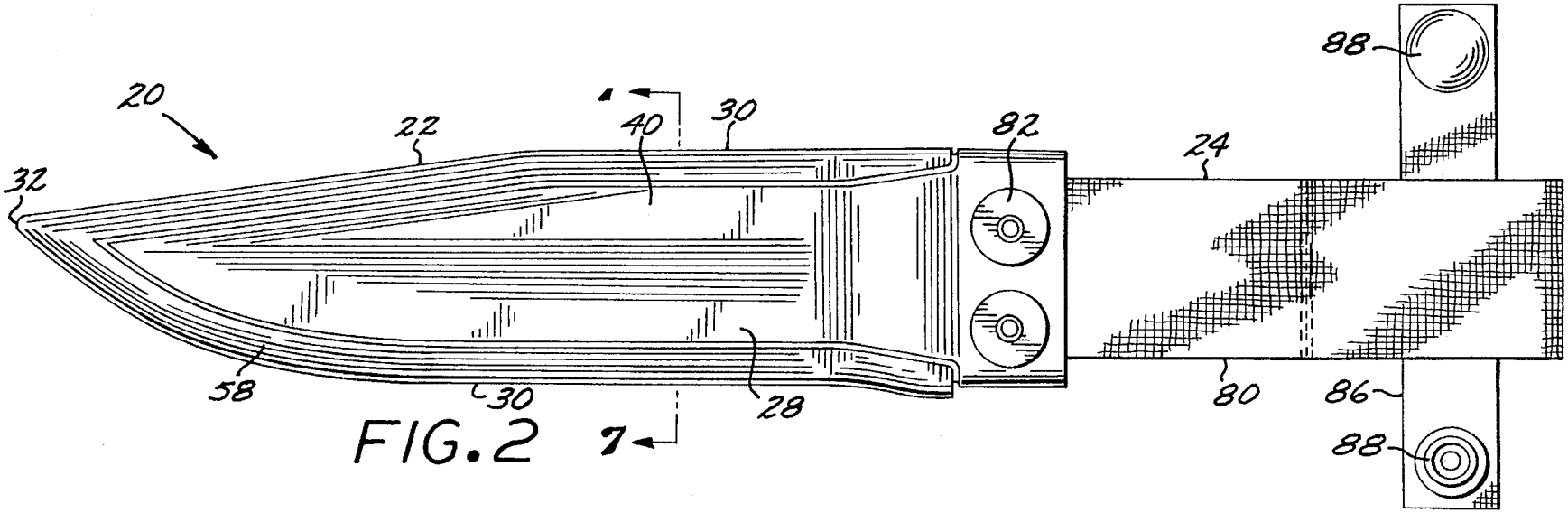
FIG. 2 is a back elevational view of the knife sheath of FIG. 1.
Figure 3:
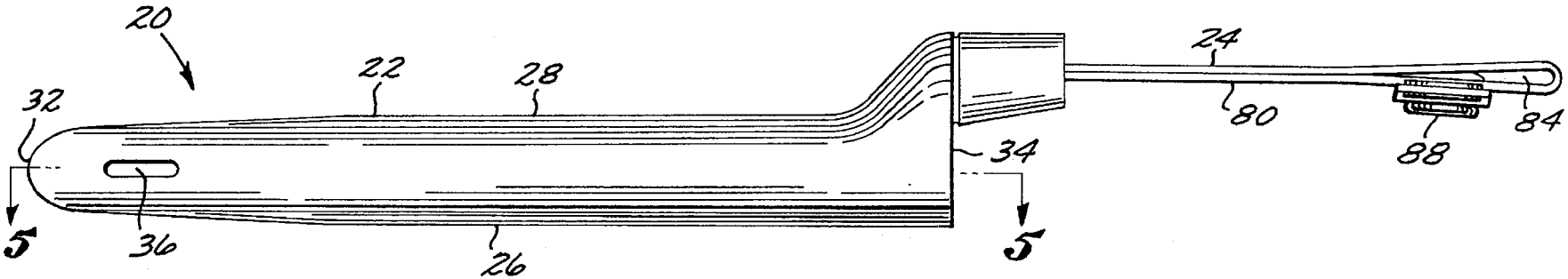
FIG. 3 is an edge elevational view of the knife sheath of FIG. 1.
Figure 4:
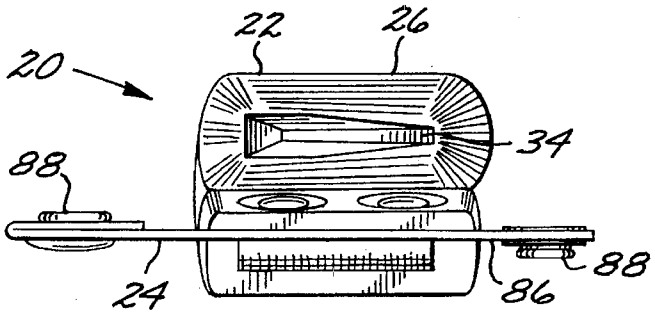
FIG. 4 is a top elevational view of the knife sheath of FIG. 1.

FIGS. 1–4 a knife sheath 20, which includes a knife receptacle 22 in which a knife (not shown) is received, and an attachment 24 that is used to attach the receptacle 22 to a belt of a user of the knife and knife sheath. The knife receptacle 22 portion of the knife sheath 20 is an elongated, hollow structure with a front side 26, an oppositely disposed back side 28, two oppositely disposed narrow edges 30, a generally closed lower end 32, and an open upper end 34 into which the knife is received for storage. At the lower end 32, a lanyard opening 36 passes through the sheath 20 from edge to edge. At the upper end 34 of the back side 28 of the knife sheath 20, the attachment 24 extends upwardly parallel to the direction of elongation of the sheath 20. The attachment 24, as shown in the figures, includes a web 80 made of fabric joined to the receptacle portion 22 by rivets 82. At the upper end of the attachment 24 is a belt loop 84 formed by overlapping and sewing the fabric of web. A strap 86 and snap closure 88 hold the knife in the sheath 20 for extended storage. In another embodiment, the skeleton structure of the knife extends upwardly to form the attachment as an integral single piece.

Figure 7:
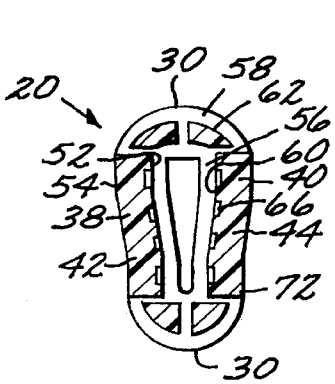
FIG. 7 is a top sectional view of the knife sheath of FIG. 1, taken along lines 7—7 of FIG. 2.
Figure 5:
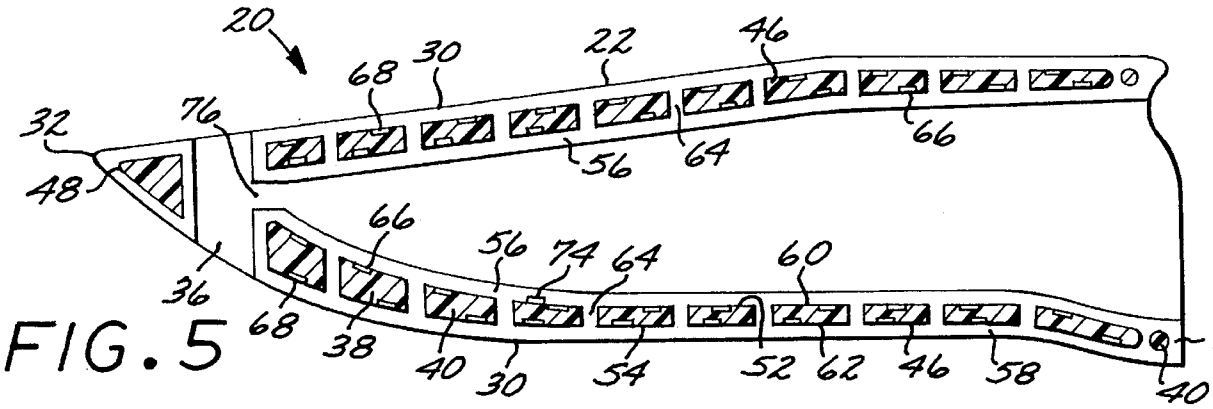
FIG. 5 is a front sectional view of the knife sheath of FIG. 1, taken along lines 5—5 of FIG. 3.
Figure 6:
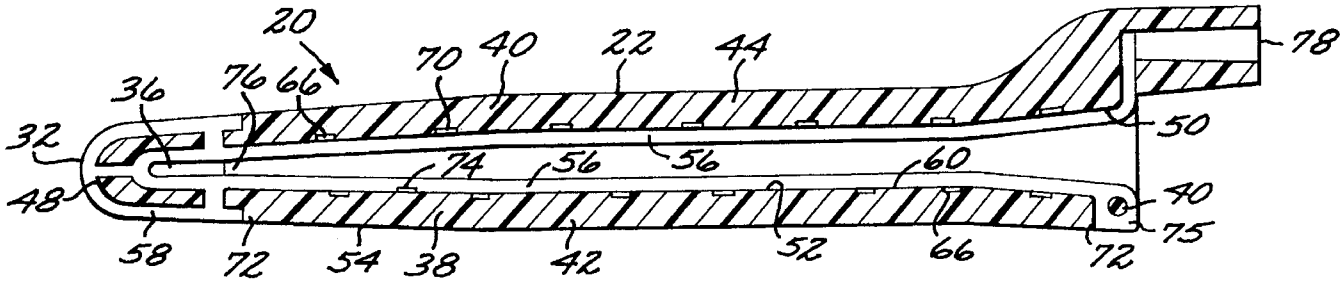
FIG. 6 is an edge sectional view of the knife sheath of FIG. 1, taken along line 6—6 of FIG. 1.
Figure 8:
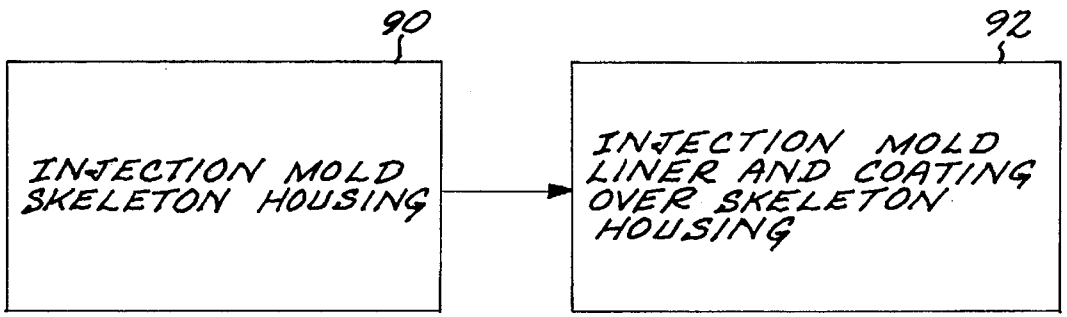
FIG. 8 is a process flow diagram for the preferred method of manufacturing the knife sheath of FIG. 1.

The sheath 20 has a composite construction that is best understood by reference to the sectional views of FIGS. 5–7. The sheath 20 has a skeleton 38 made of a first material. The skeleton 38 includes an elongated skeleton housing 40 having a front side 42, an oppositely disposed back side 44, two oppositely disposed narrow edges 46, a generally closed lower end 48, and an open upper end 50. The skeleton housing 40 may be described as having an interior 52 and an exterior 54.

A liner 56 made of a second material covers at least a portion of the interior 52 of the skeleton housing 40. In the embodiment of FIGS. 5–7, the liner 56 covers substantially all of the interior 52 of the skeleton housing 40, except for the opening at the lower end 32 that will be discussed subsequently.

A coating 58 made of a third material covers at least a portion of the exterior 54 of the skeleton housing 40. In the embodiment of FIGS. 1–7, the coating 58 does not cover all of the exterior of the skeleton housing. Instead, the coating 58 covers the edges 46 and the lower end 48, thereby becoming the material found at the edges 30 and the lower end 32, respectively, of the knife receptacle 22. The front side 42 and the back side 44 of the skeleton housing 38 are exposed along, and become, the front side 26 and the back side 28, respectively, of the knife receptacle 22. In another embodiment, the coating 58 covers substantially all of the exterior of the sheath, so that it becomes the entire visible front side 26, back side 32, and edges 30 of the receptacle 22 portion of the sheath 20.

The first material from which the skeleton housing 40 is made is preferably a relatively rigid plastic that can be formed by injection molding, and is strong and durable. A preferred such plastic is kevlar-filled nylon-66 or glass-filled nylon-66. This material is strong, tough, abrasion resistant, fire resistant, resistant to attack by acids and chemicals, and injection moldable. In the preferred material, about 5–6 volume percent of kevlar is dispersed within Zytel nylon-66 plastic. As used herein, the term "plastic" is to be broadly construed to include hard, strong plastic materials. The second material from which the liner 56 is made is preferably an elastomer or rubbery material. For use in the preferred injection molding operation, the second material is preferably a thermoplastic rubber which has an acceptable hardness and is resistant to damage in adverse environments such as heat, solvents, and acids. The thermoplastic rubber preferably has a durometer Shore A hardness of from about 50 to about 90, which has been found to provide a suitable compromise of firmness and compliancy. The most preferred elastomer is a polyolefin elastomer. Such a rubber is available commercially from DuPont as Alcryn 2060 thermoplastic rubber having a Shore A durometer hardness of about 60. The third material from which the coating 58 is preferably made is also an elastomer, and is most preferably the same elastomer as the second material. That is, the liner 56 and the coating 58 are preferably made of the same elastomer material. By such a choice, the liner 56 and the coating 58 can be formed simultaneously in an injection molding operation to be discussed subsequently.

In a typical knife sheath 20 such as shown in FIGS. 1–7, the thickness of the first material that forms the skeleton housing 40 has an average thickness of about 0.12 inches, although there is some variation with position within the skeleton. The thickness of the liner 56 is about 0.10 inches, and the thickness of the coating 58 is about 0.10 inches. Thus, the liner 56 is a relatively thin layer formed over a housing/liner surface 60, and the coating 58 is a relatively thin layer formed over a housing/coating surface 62. The surfaces 60 and 62 are on the order of an inch wide (in the edge-to-edge direction of the sheath) and on the order of 6 inches or more in length (between the upper end and the lower end of the sheath).

When a relatively thin layer is applied over a relatively extensive surface, as here, there is a tendency for the thin layer to shear and peel away from the surface. In the present approach, care is taken to achieve a high degree of adherence of the liner 56 to the skeleton housing 40 along the housing/liner surface 60. Similarly, care is taken to achieve a high degree of adherence of the coating 58 to the skeleton housing 40 along the housing/coating surface 62. Three types of structural features are provided to aid in this adherence.

The first type of structural feature is at least one, and preferably a plurality of, communication openings 64 through the skeleton housing 40 extending between the liner 56 and the coating 58, as best seen in FIG. 5. These communication openings 64 do not extend through the coating 58 to the exterior of the knife sheath 20. Thus, the communication openings 64 are not visible from the exterior of the knife sheath 20 to the user or others. The communication openings 64 cause the liner 56 and the coating 58 to be continuous with a small core of material extending therebetween through each of the communication openings 64. The liner 56 thus serves as part of the structure to hold the coating 58 in place, and the coating 58 serves as part of the structure to hold the liner 56 in place. The core of material also serves to draw the liner 56 and coating 58 tightly against the respective surfaces 60 and 62.

The second type of structural feature is a three-dimensional feature formed on the surface 60 to aid in anchoring the liner 56 to the surface 60, and a three-dimensional feature formed on the surface 62 to aid in anchoring the coating 58 to the surface 62. The preferred form of the three-dimensional anchoring feature is a channel 66 in the surface 60 and a channel 68 in the surface 62. The channels 66 and 68 may be of two types. A simple groove is formed in the broad portions of the surfaces 60 and 62, an example of which is indicated by numeral 70. A corner recess channel, an example of which is indicated by numeral 72, is formed along the contiguous edge where the plastic material of the skeleton housing 40 and the elastomer material of the liner 56 or the coating 58 meet. This corner recess channel 72 aids in preventing the elastomer from peeling, or being peeled, back from the edge of the plastic. While channels 66 and 68 are preferred as the anchoring three-dimensional feature, projections 74 molded into the surface of the skeleton housing 40 can also be used in this role.

Adherence and peel resistance of the liner 56 and the coating 58 are also aided by making the liner 56 and the coating 58 continuous over at least a portion of the upper end of the sheath 34, see numeral 75 in FIGS. 5 and 6.

The lanyard opening 36 is optionally formed in the skeleton housing 40 to extend from edge to edge through the lower end 48 of the skeleton housing 40. The lower end 48 is otherwise closed to retain the knife within the knife sheath 20, and for this reason the lower end 48 and the lower end 32 are described as "generally" closed. Desirably, the lanyard opening 36 also communicates with the interior of the knife sheath 20 through an access opening 76. The access opening 76 permits any water within the sheath 20 to drain out into the lanyard opening 36, which in this sense is a pan of the access opening, and away.

The spacing between the interior surfaces 52 of the skeleton housing 40 is desirably tapered inwardly by a small amount from the upper end 50 toward the lower end 42 to about ¾ of their thickness at the upper end. The spacing between the interior surfaces of the liner 56 tapers inwardly in a corresponding manner, as may be seen most clearly in FIG. 6. This inward taper, in combination with the continuity of the liner 56 and the coating 58 (numeral 75) acts in the manner of a funnel to aid in inserting the knife smoothly into the sheath 20.

FIG. 7 depicts a preferred approach for manufacturing the knife sheath 20. The skeleton housing 40 and the continuous attachment 24 are molded as a single integral piece, preferably by injection molding, numeral 90. Other operable molding techniques such as casting or cold molding can also be used, and the term "molding" encompasses all such operable molding techniques. Injection molding permits the various features described previously to be readily provided by forming these features into a die into which the molten first material is injected.

The liner 56 and coating 58 are thereafter injection molded, numeral 92, of the same elastomeric material overlying the skeleton housing 40 in a second injection molding die. To accomplish this injection molding of the liner 56, a sprue 78 is typically provided in the skeleton housing 40, so that the elastomeric material can be injected through this sprue. In the presently preferred design, the injected molten elastomer flows through the sprue 78 from an external source (FIG. 6), into the space defined by the mold for the liner 56, through the communication openings 64 (FIG. 7), and thence into the coating 58. The molten elastomer penetrates the openings 64, the channels 66, the channels 68, and all other regions permitted by the second injection molding die and the form of the skeleton housing 40. Where a web attachment is used, the web is attached with rivets.

The present invention thus provides a knife sheath and method for its manufacture. The knife sheath is rugged, attractive in appearance, and actually less expensive to produce than many conventional sheaths because of the injection molded structure. The elastomer in the liner interior of the sheath cushions the knife and holds it securely within the sheath quietly. The elastomer along the edges of the coating exterior of the sheath prevents noise when the edges of the sheath strike rocks and the like as the user is walking.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A knife sheath comprising a knife receptacle including:

a skeleton made of a first material, the skeleton comprising an elongated skeleton housing having a front side, an oppositely disposed back side, two oppositely disposed narrow edges, a generally closed lower end, and an open upper end;

a liner made of a second material, the liner covering at least a portion of an interior of the skeleton housing; and a coating made of a third material, the coating covering at least a portion of an exterior of the skeleton housing, wherein the first material is a plastic, the second material is an elastomer, and the third material is an elastomer.

2. The knife sheath of claim 1, wherein the generally closed lower end includes an access opening therethrough.

3. The knife sheath of claim 1, wherein the liner covers substantially the entire interior of the skeleton housing.

4. The knife sheath of claim 1, wherein the coating covers the edges and the generally closed lower end of the skeleton housing.

5. The knife sheath of claim 1, wherein the skeleton housing includes at least one communication opening therethrough extending between the liner and the coating, so that the liner and the coating are continuous.

6. The knife sheath of claim 5, wherein the liner and the coating are made of the same material.

7. The knife sheath of claim 1, further comprising:

an attachment joined to the knife receptacle at an upper end thereof.

8. The knife sheath of claim 7, wherein the attachment comprises a fabric web joined to the skeleton housing.

9. A knife sheath comprising:

a skeleton made of a plastic first material, the skeleton comprising an elongated skeleton housing having a front side, an oppositely disposed back side, two oppositely disposed narrow edges, a generally closed lower end, and an open upper end;

a liner made of an elastomer second material, the liner covering an entire interior of the skeleton housing;

a coating made of the elastomer second material, the coating covering at least a portion of an exterior of the skeleton housing;

means for forming a continuous path between the liner and the coating, the means for forming including at least one communication opening extending through the skeleton housing between the liner and the coating;

means for anchoring the liner to the skeleton housing;

means for anchoring the coating to the skeleton housing; and an attachment joined to the back side of the skeleton housing at the upper end thereof.

10. The knife sheath of claim 9, wherein the generally closed lower end includes an access opening therethrough.

11. The knife sheath of claim 9, wherein the coating covers the edges and the generally closed lower end of the skeleton housing.

12. The knife sheath of claim 9, wherein the means for anchoring the liner to the skeleton housing includes at least one of a first three-dimensional feature formed in a housing/liner surface of the skeleton housing between the skeleton housing and the liner, and wherein the means for anchoring the coating to the skeleton housing includes at least one of a second three-dimensional feature formed in a housing/coating surface of the skeleton housing between the skeleton housing and the coating.

13. The knife sheath of claim 12, wherein the first three-dimensional feature is a first channel in the housing/liner surface of the skeleton housing, and wherein the second three-dimensional feature is a second channel in the housing/coating surface of the skeleton housing.

14. A knife sheath comprising a knife receptacle including:

a skeleton made of a first material, the skeleton comprising an elongated skeleton housing having a front side, an oppositely disposed back side, two oppositely disposed narrow edges, a generally closed lower end, and an open upper end, wherein the generally closed lower end includes an access opening therethrough extending between the two oppositely disposed narrow edges;

a liner made of a second material, the liner covering at least a portion of an interior of the skeleton housing; and a coating made of a third material, the coating covering at least a portion of an exterior of the skeleton housing.

15. A knife sheath comprising:

a skeleton made of a first material, the skeleton comprising an elongated skeleton housing having a front side, an oppositely disposed back side, two oppositely disposed narrow edges, a generally closed lower end, and an open upper end;

a liner made of a second material, the liner covering an entire interior of the skeleton housing;

a coating made of the second material, the coating covering at least a portion of an exterior of the skeleton housing;

means for forming a continuous path between the liner and the coating, the means for forming including at least one communication opening extending through the skeleton housing between the liner and the coating;

means for anchoring the liner to the skeleton housing, wherein the means for anchoring the liner to the skeleton housing includes at least a first three-dimensional feature formed in a housing/liner surface of the skeleton housing between the skeleton housing and the liner;

means for anchoring the coating to the skeleton housing, wherein the means for anchoring the coating to the skeleton housing includes at least a second three-dimensional feature formed in a housing/coating surface of the skeleton housing between the skeleton housing and the coating; and an attachment joined to the back side of the skeleton housing at the upper end thereof.

16. The knife sheath of claim 15, wherein the first three-dimensional feature is a first channel in the housing/liner surface of the skeleton housing, and wherein the second three-dimensional feature is a second channel in the housing/coating surface of the skeleton housing.

17. The knife sheath of claim 15, wherein the first material is a plastic and the second material is an elastomer.

18. The knife sheath of claim 15, wherein the generally closed lower end includes an access opening therethrough.

19. The knife sheath of claim 15, wherein the coating covers the edges and the generally closed lower end of the skeleton housing.

* * * * *